US009431741B2

(12) United States Patent
Takahashi

(10) Patent No.: US 9,431,741 B2
(45) Date of Patent: Aug. 30, 2016

(54) SOCKET CONTACT

(71) Applicant: JAPAN AVIATION ELECTRONICS INDUSTRY, LIMITED, Shibuyaku, Tokyo (JP)

(72) Inventor: Takeshi Takahashi, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 14/679,990

(22) Filed: Apr. 6, 2015

(65) Prior Publication Data

US 2015/0311615 A1 Oct. 29, 2015

(30) Foreign Application Priority Data

Apr. 23, 2014 (JP) ..... 2014-089353

(51) Int. Cl.

| | |
|---|---|
| ***H01R 13/18*** | (2006.01) |
| ***H01R 13/15*** | (2006.01) |
| ***H01R 13/187*** | (2006.01) |
| *H01R 13/11* | (2006.01) |

(52) U.S. Cl.

CPC ..... *H01R 13/187* (2013.01); *H01R 13/18* (2013.01); *H01R 13/111* (2013.01)

(58) Field of Classification Search

CPC ..... H01R 13/18; H01R 13/15

See application file for complete search history.

(56) References Cited

U.S. PATENT DOCUMENTS 2,346,831 A * 4/1944 Drury ..... H01R 13/18 16/108
3,715,708 A * 2/1973 Lloyd ..... H01R 24/40 439/675
4,035,045 A * 7/1977 Trevithick ..... H01R 13/648 439/101
4,550,972 A * 11/1985 Romak ..... H01R 13/111 439/839
5,021,011 A * 6/1991 Kawanami ..... H01R 24/40 439/582
5,362,262 A * 11/1994 Hotea ..... H01R 13/18 439/839
5,868,590 A * 2/1999 Dobbelaere ..... H01R 13/18 439/839
5,921,803 A 7/1999 Mori et al.
6,955,569 B2 * 10/2005 Baker ..... H01R 13/18 439/839
7,658,657 B1 * 2/2010 Scanzillo ..... H01R 13/17 439/825
8,317,552 B2 * 11/2012 Leroyer ..... H01R 13/111 439/839
8,956,170 B2 * 2/2015 White ..... H01R 13/4367 439/252
2005/0032440 A1 * 2/2005 Kurimoto ..... H01R 13/18 439/839

FOREIGN PATENT DOCUMENTS

JP 08222314 A 8/1996

* cited by examiner

*Primary Examiner* — Gary Paumen
(74) *Attorney, Agent, or Firm* — Holtz, Holtz & Volek PC

(57) ABSTRACT

A socket contact which is reduced in manufacturing costs and has a spring member difficult to be removed from a socket contact body. The socket contact includes a socket contact body, and a spring member fitted on the socket contact body. The spring member includes an elastic annular portion and at least one protruding portion provided on the elastic annular portion. A hollow cylindrical contact portion of the socket contact body for receiving a pin contact therein is formed with at least one slit that extends in a receiving direction in which the contact portion receives the pin contact therein, and a hole that receives the protruding portion for limiting the movement of the spring member in a direction parallel to the receiving direction.

14 Claims, 12 Drawing Sheets

SOCKET CONTACT

BACKGROUND OF THE INVENTION

1. Field of the Invention

This invention relates to a socket contact.

2. Description of the Related Art

Conventionally, as shown in FIGS. 11 and 12, there has been proposed a charging connector terminal 955 (socket contact) including an electric contact portion 913 having a hollow cylindrical shape, and an auxiliary spring (spring member) 963 which has an annular shape and is fitted on an outer periphery of the electric contact portion 913 (see Japanese Patent Laid-Open Publication No. H8-222314).

Four slits 957 extending in the direction of the central axis of the electric contact portion 913 are formed in the hollow cylindrical electric contact portion 913, at equally-spaced intervals in a circumferential direction of the electric contact portion 913, whereby the electric contact portion 913 is divided into four contact plates 959. Front end portions of the four contact plates 959 are elastically deformable in respective radial directions of the electric contact portion 913. Outer grooves 961 extending in the circumferential direction of the electric contact portion 913 are formed in respective outer peripheries of the four contact plates 959.

The inner diameter of the auxiliary spring 963 is slightly smaller than the outer diameter of the electric contact portion 913. The auxiliary spring 963 is fitted in the outer grooves 961.

When an electric contact portion 921A, which has a pin shape, of a male terminal 921 is inserted into the electric contact portion 913 of the charging connector terminal 955, the respective front end portions of the four contact plates 959 are displaced outward, whereby the diameter of the auxiliary spring 963 is increased. At this time, the inner peripheries of the front end portions of the contact plates 959 are pressed against the outer periphery of the electric contact portion 921A of the male terminal 921, by the returning forces of the contact plates 959 and the auxiliary spring 963, whereby predetermined contact forces are generated between the front end portions of the contact plates 959 of the charging connector terminal 955 and the electric contact portion 921A of the male terminal 921.

As described above, for the charging connector terminal 955, a structure is employed in which the auxiliary spring 963 is fitted in the outer grooves 961 formed in the outer peripheries of the four contact plates 959, and hence holding forces with which the outer grooves 961 hold the auxiliary spring 963 are small, so that there is a fear that the auxiliary spring 963 is easily removed from the electric contact portion 913.

Further, in the case of the structure including the outer grooves 961 formed in the outer peripheries of the four contact plates 959, the socket contact is manufactured by cutting, and hence the amount of waste material is large. This is one of factors which increase the manufacturing costs of the socket contact (charging connector terminal 955).

SUMMARY OF THE INVENTION

The present invention has been made in view of these circumstances, and an object thereof is to provide a socket contact that is capable of reducing manufacturing costs thereof and has a spring member difficult to be removed from a socket contact body.

To attain the above object, the present invention provides a socket contact comprising a socket contact body including a contact portion, which has a hollow cylindrical shape, for receiving a pin contact therein, and a spring member fitted on the socket contact body, the spring member including an elastic annular portion fitted on an outer periphery of the contact portion, and at least one protruding portion provided on the elastic annular portion, wherein the contact portion has at least one slit formed therein which extends in a direction of receiving the pin contact, wherein the contact portion has a receiving portion formed therein for receiving the protruding portion and limiting movement of the elastic annular portion in a direction parallel to the direction of receiving the pin contact, and wherein the contact portion has a contact point portion that is pressed against an outer periphery of the pin contact by returning force of the elastic annular portion when the pin contact is received into the contact portion.

Preferably, when the receiving portion has received the protruding portion therein, a front end of the protruding portion does not protrude inward of an inner peripheral surface of the contact portion.

Preferably, the receiving portion is a hole or a cutout.

Preferably, the socket contact body includes a body portion having a cylindrical shape, and a connection portion provided at one end of the body portion, for being connected to an object to be connected, and the contact portion has elasticity, and is provided at the other end of the body portion.

More preferably, the object to be connected is a wire, and the connection portion is formed to have a hollow cylindrical shape such that the connection portion can receive one end of the wire therein.

Preferably, the at least one slit comprises four slits, and the four slits are arranged at equally-spaced intervals in a circumferential direction of the contact portion.

Preferably, the socket contact body is made of a pure copper-based material.

Preferably, the spring member is made of a metal material having high heat resistance.

Preferably, the socket contact body except the receiving portion is made by cold forging.

According to the present invention, it is possible to provide a socket contact that is capable of reducing manufacturing costs thereof and has a spring member difficult to be removed from a socket contact body.

The above and other objects, features and advantages of the present invention will become more apparent from the following detailed description taken in conjunction with the accompanying drawings.

DETAILED DESCRIPTION OF THE PREFERRED EMBODIMENT

Figure 1:
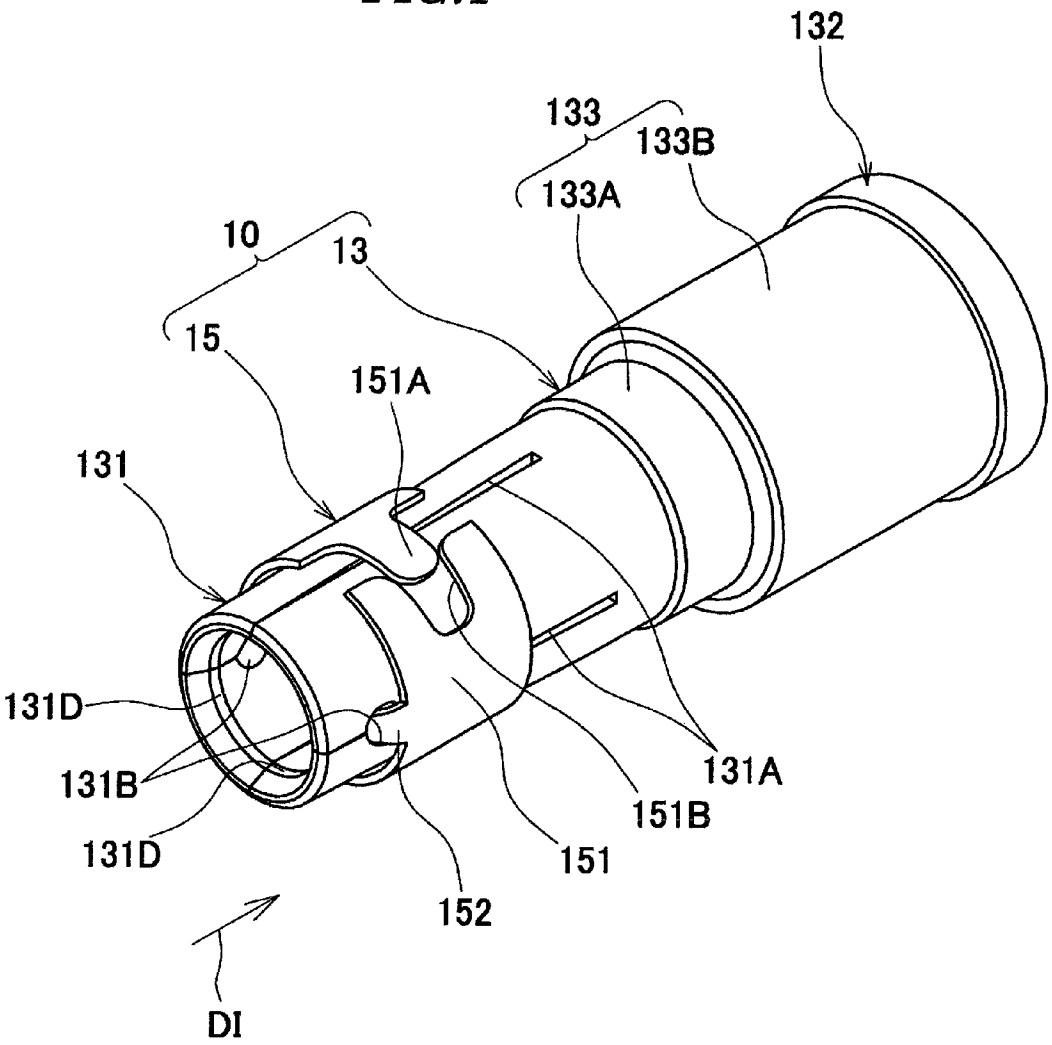
FIG. 1 is a perspective view of a socket contact according to a first embodiment of the present invention.

The present invention will now be described in detail with reference to the drawings showing preferred embodiments thereof.

First, a socket contact according to a first embodiment of the present invention will be described with reference to FIGS. 1 to 7.

The socket contact 10 is comprised of a socket contact body 13 and a spring member 15. The socket contact 10 according to the present embodiment is used as a large-current socket contact.

The socket contact body 13 includes a contact portion 131, a connection portion 132, and a body portion 133.

The connection portion 132, which has a disk shape and is connected e.g. to a bus bar (object to be connected), not shown, is provided at one end of the body portion 133 which has a cylindrical shape. The contact portion 131, which has a hollow cylindrical shape, is provided at the other end of the body portion 133. Four slits 131A and two holes (receiving portions) 131B are formed in the contact portion 131.

The contact portion 131 receives a pin contact, not shown, therein. The outer diameter of a front end portion of the contact portion 131 is slightly smaller than the outer diameter of a rear end portion of the contact portion 131.

Each slit 131A extends in a receiving direction DI in which the contact portion 131 receives the pin contact therein. The four slits 131A are arranged at equally-spaced intervals in a circumferential direction of the contact portion 131 (see FIG. 3). The contact portion 131, which has a hollow cylindrical shape, is formed with the four slits 131A, whereby four contact pieces 131C are formed. A contact point portion 131D for being brought into contact with an outer periphery of the pin contact is formed on the inner periphery of a front end portion of each contact piece 131C.

Each hole 131B is formed such that it meets one of the slits 131A, and is divided by the slit 131A into two in the circumferential direction of the contact portion 131. The two holes 131B are opposed to each other in a diametrical direction of the contact portion 131.

The connection portion 132 is connected to the bus bar e.g. by ultrasonic bonding, welding, or soldering. Note that the connection portion 132 may be connected to the bus bar with bolts by forming screw holes (not shown) in an end face of the connection portion 132.

The body portion 133 includes a small-diameter portion 133A and a large-diameter portion 133B. The outer diameter of the large-diameter portion 133B is larger than the outer diameter of the small-diameter portion 133A and is smaller than the outer diameter of the connection portion 132.

The respective central axes of the contact portion 131, the body portion 133, and the connection portion 132 coincide with each other.

The socket contact body 13 except the contact portion 131 has a solid structure (structure having no void therein).

Figure 3:
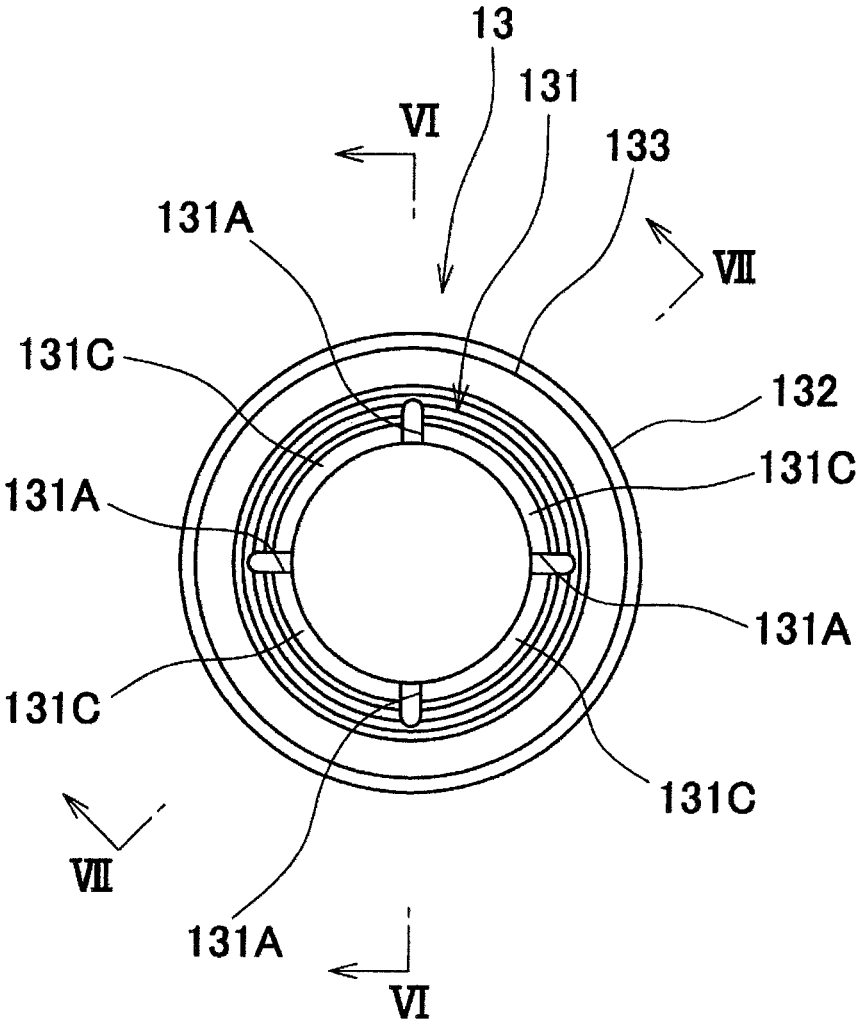
FIG. 3 is a front view of the socket contact body appearing in FIG. 1.
Figure 4:
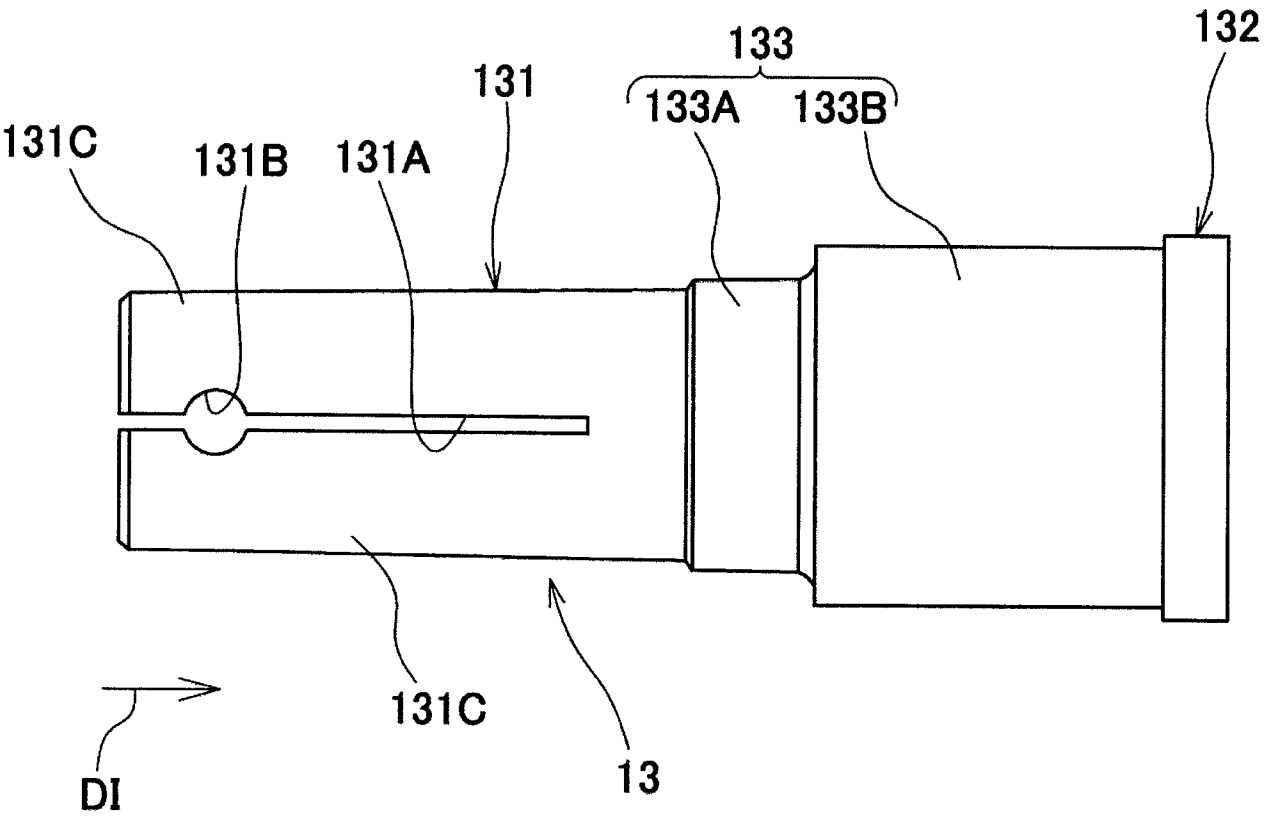
FIG. 4 is a side view of the socket contact body appearing in FIG. 1.
Figure 5:
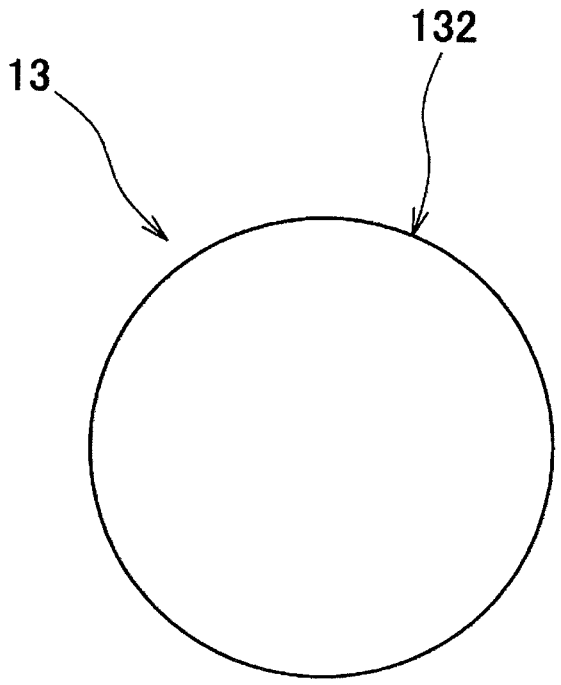
FIG. 5 is a rear view of the socket contact body appearing in FIG. 1.
Figure 6:
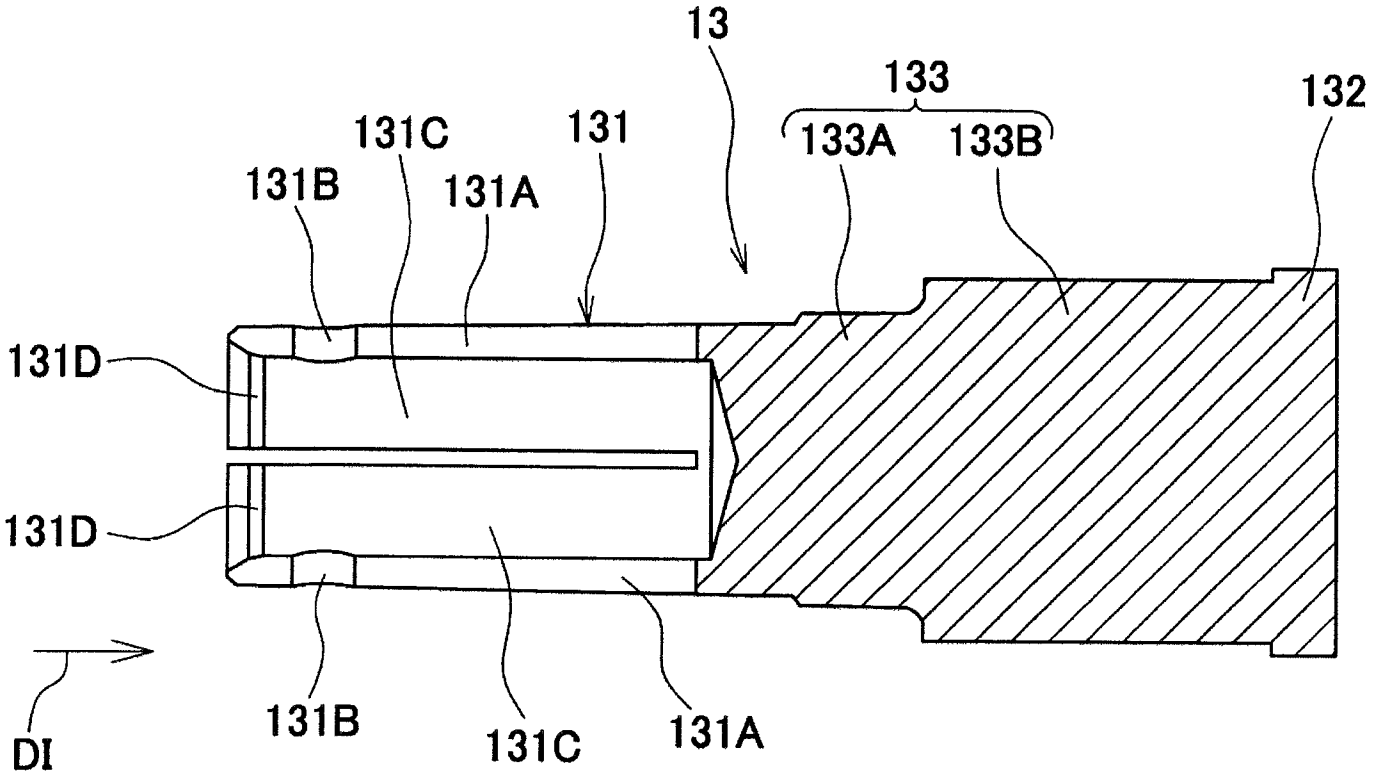
FIG. 6 is a cross-sectional view taken along VI-VI in FIG. 3.
Figure 7:
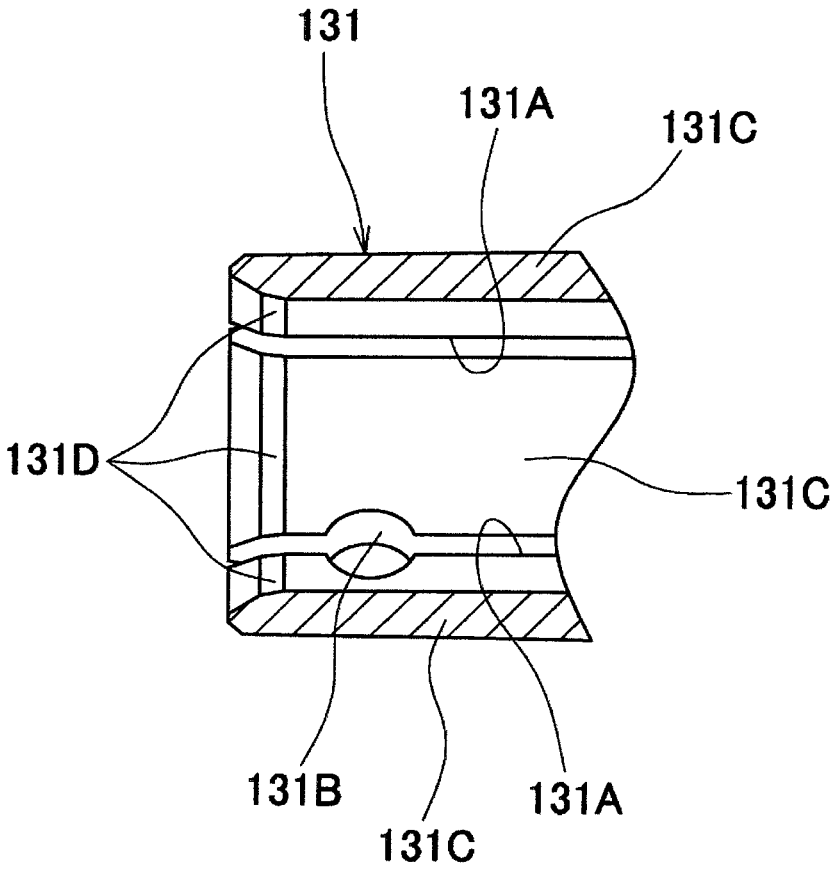
FIG. 7 is a partial cross-sectional view taken along VII-VII in FIG. 3.

The socket contact body 13 has no hidden portion other than the holes 131B, as viewed from the front (see FIG. 3). Therefore, as described hereinafter, it is possible to form the socket contact body 13 except the holes 131B by cold forging.

The spring member 15 includes an elastic annular portion 151 and two protruding portions 152. When the contact portion 131 of the socket contact body 13 receives the pin contact therein, the elastic annular portion 151 of the spring member 15 is elastically deformed, and the contact point portions 131D of the contact portion 131 are pressed against the outer periphery of the pin contact by the returning force of the elastic annular portion 151.

The elastic annular portion 151 is formed by bending a metal plate into an annular shape, and is elastically deformable in a diametrical direction thereof. A protruding portion 151A is formed at one end of the elastic annular portion 151 in a circumferential direction thereof, and a recess 151B for receiving the protruding portion 151A is formed at the other end of the elastic annular portion 151. The inner diameter of the elastic annular portion 151 is smaller than the outer diameter of the contact portion 131 measured when the front end portion of the contact portion 131 is made narrower in diameter to form a smaller opening.

Figure 2:
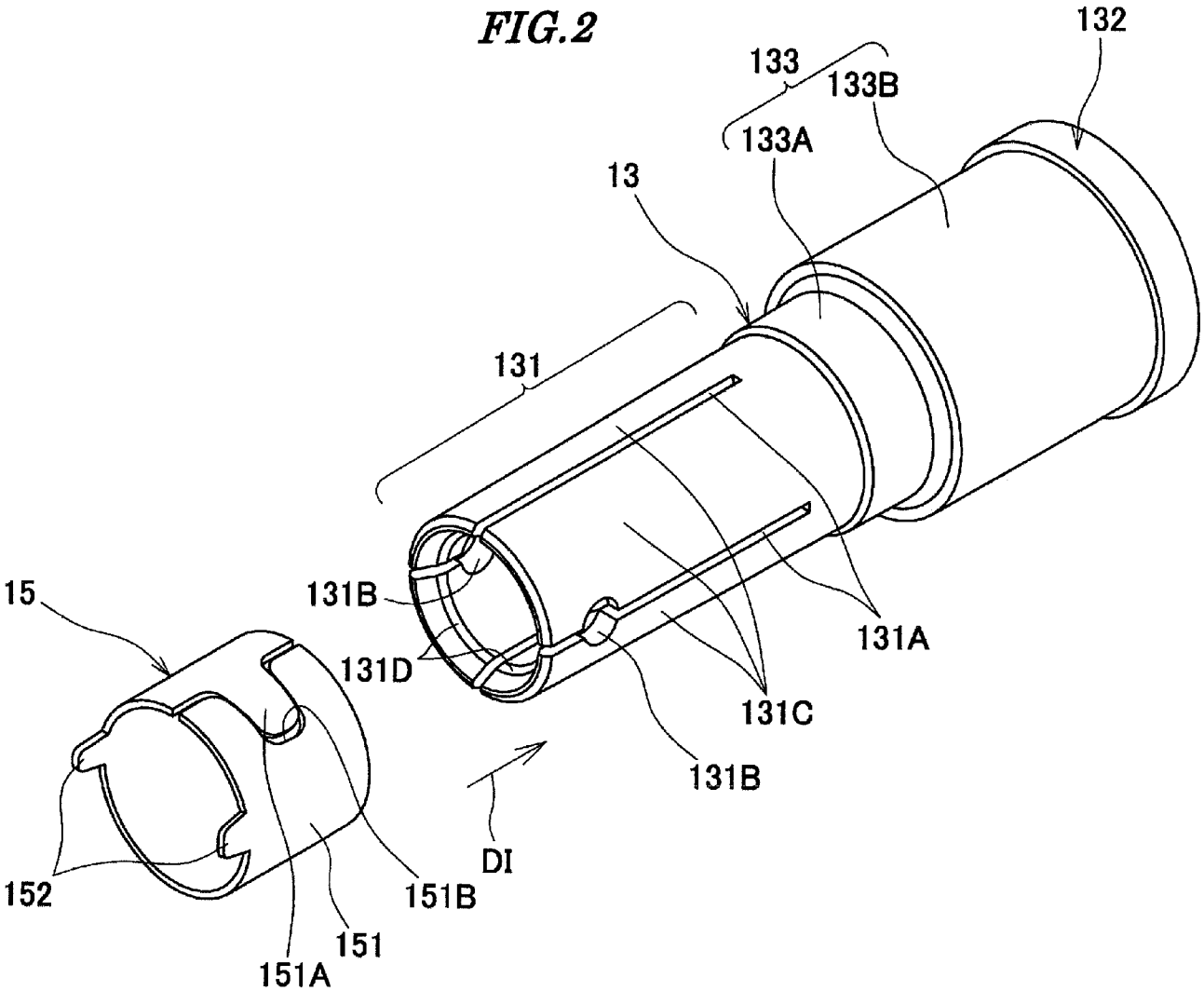
FIG. 2 is a perspective view of the socket contact shown in FIG. 1 in a state before a spring member is fitted on a socket contact body.

In the present embodiment, before the spring member 15 is fitted on the outer periphery of the contact portion 131, the two protruding portions 152 protrude straight from a front end of the elastic annular portion 151 (one end of the elastic annular portion 151 in the direction of the central axis thereof) in a direction opposite to the receiving direction DI (see FIG. 2). The two protruding portions 152 are opposed to each other in the diametrical direction of the elastic annular portion 151.

After the spring member 15 is fitted on the outer periphery of the contact portion 131, the protruding portions 152 are bent in the radial direction of the elastic annular portion 151, and front ends of the protruding portions 152 are inserted into respective associated ones of the holes 131B (see FIG. 1), as described hereinafter. As a consequence, movement of the spring member 15 in a direction parallel to the receiving direction DI is restricted.

However, the protruding portions 152 are bent such that the front ends thereof do not protrude into the inner space of the contact portion 131. Further, when the front end of each protruding portion 152 is inserted into the associated hole 131B, a predetermined clearance is formed between the protruding portion 152 and the inner peripheral surface of the hole 131B. This clearance is provided for preventing the contact portion 131 from interfering with movement of the protruding portion 152 in the circumferential direction of the contact portion 131 caused when the pin contact is inserted into the contact portion 131, to thereby prevent the contact portion 131 from blocking elastic deformation of the elastic annular portion 151 in a direction in which the elastic annular portion 151 is increased in diameter. Therefore, the length of each hole 131B in the circumferential direction of the contact portion 131 is sufficiently larger than the length of each protruding portion 152 in the circumferential direction of the contact portion 131.

Note that when only one protruding portion 152 and only one hole 131B are employed, it is only required to insert the protruding portion 152 deep into the hole 131B, and it is not essential to provide the clearance described above. This is because if one protruding portion 152 and one hole 131B are provided, the elastic deformation of the elastic annular portion 151 in the direction in which the elastic annular portion 151 is increased in diameter is not blocked.

Next, a method of manufacturing the socket contact 10 will be described with reference to FIGS. 1 and 2.

To manufacture the socket contact body 13, first, a socket contact body intermediate (socket contact body 13 in a state in which the portions other than the holes 131B are formed), not shown, is formed from a cylindrical material (not shown) made of a pure copper-based material, by cold forging. Examples of the pure copper-based material include pure copper materials, such as oxygen-free copper and tough pitch copper, and copper materials having a purity lower than but close to the purity of the pure copper materials.

Next, the two holes 131B are formed by removal work, such as cutting.

The socket contact body 13 is completed through the above-described processes.

To manufacture the spring member 15, first, a spring member intermediate, not shown, is formed by blanking a metal plate made of a metal material having high heat resistance into a predetermined shape (developed shape of the spring member 15) through press work. Examples of the metal material having high heat resistance include stainless steel, zirconium copper, and titanium copper.

Next, the elastic annular portion 151 is formed by bending the spring member intermediate into an annular shape through bending work. At this stage, the protruding portions 152 are not bent, which means that the spring member 15 has not been completed yet, and hence in a strict sense, the bent metal plate is not the spring member 15 but it is still a spring member intermediate. However, the spring member intermediate at this stage is also referred to as the spring member 15, for convenience of description.

To assemble the spring member 15 to the socket contact body 13 manufactured as described above, first, the front end portion of the contact portion 131 is made narrower in diameter until the contact pieces 131C are brought into contact with each other in the circumferential direction of the contact portion 131.

Next, the diameter of the elastic annular portion 151 of the spring member 15 is increased, and the spring member 15 is fitted on the contact portion 131 of the socket contact body 13 in a manner such that the spring member 15 is wound around the outer periphery of the contact portion 131. After that, the spring member 15 is positioned with respect to the contact portion 131 such that the holes 131B and associated ones of the protruding portions 152 are opposed to each other.

Finally, the front ends of the protruding portions 152 are bent and inserted into the respective associated ones of the holes 131B, using a jig having a bar-like shape (not shown). In doing this, care is taken to ensure that the front ends of the protruding portions 152 do not protrude into the inner space of the contact portion 131 of the socket contact body 13 (space inward of the inner peripheral surface of the contact portion 131). Note that although in the present embodiment, the front ends of the protruding portions 152 are bent after the spring member 15 is fitted on the socket contact body 13, the front ends of the protruding portions 152 may be bent in advance before the spring member 15 is fitted on the socket contact body 13.

The fitting of the spring member 15 on the socket contact body 13 is completed through the above-described processes, whereby the socket contact 10 is completed.

Figure 11:
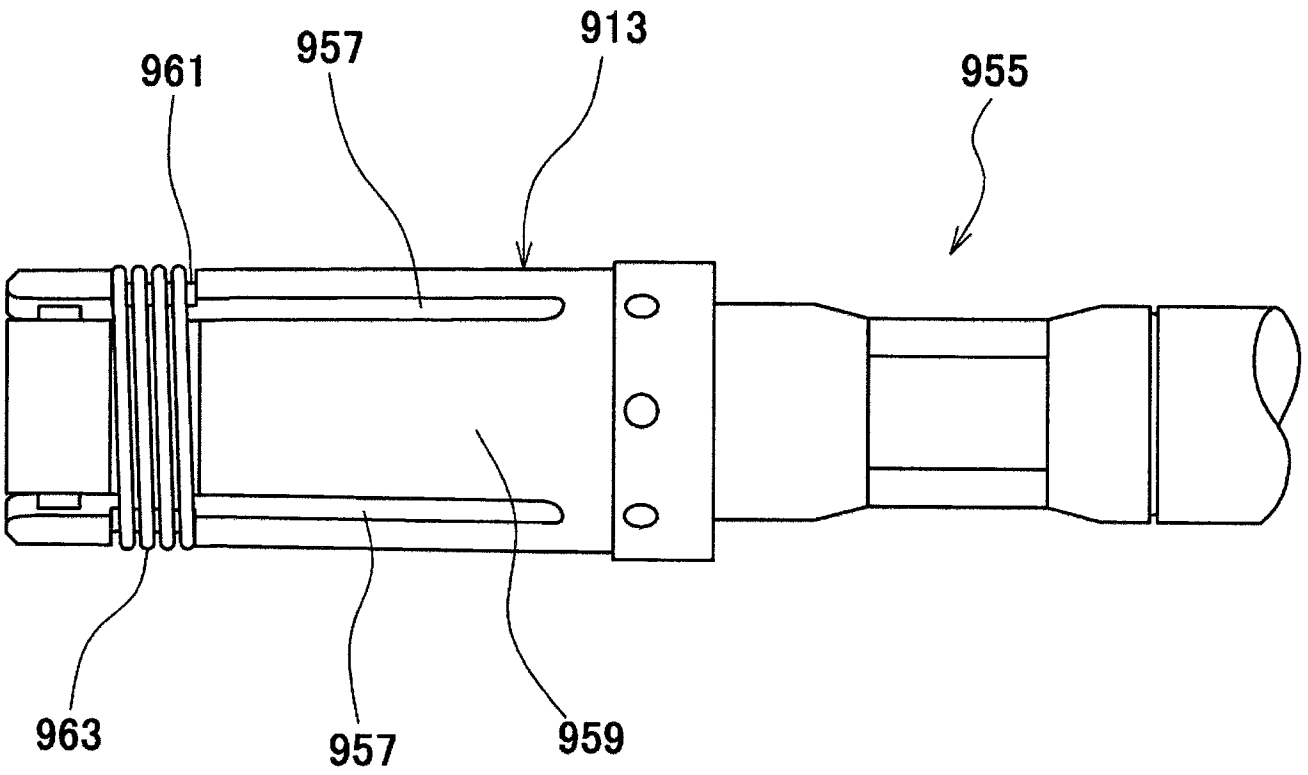
FIG. 11 is a side view of a conventional socket contact (charging connector terminal).
Figure 12:
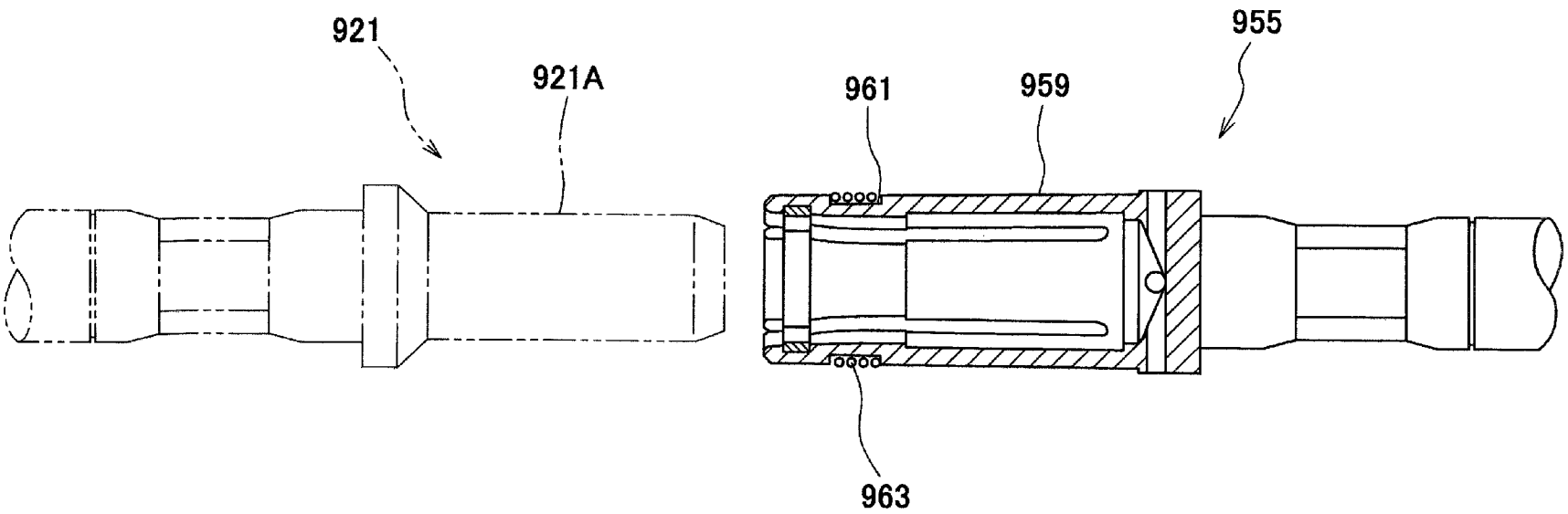
FIG. 12 is a cross-sectional view of the socket contact shown in FIG. 11.

According to the present embodiment, the movement of the spring member 15 in the direction parallel to the receiving direction DI is restricted by inserting the protruding portions 152 of the spring member 15 into the holes 131B of the socket contact body 13, and hence there is no need to form the outer grooves 961 (see FIGS. 11 and 12) surrounding the outer periphery of the contact portion 131 through cutting work for the purpose of prevention of removal of the spring member 15. As a result, when the socket contact body 13 is manufactured, the amount of waste material is largely reduced, and hence manufacturing costs can be reduced. Further, the holes 131B are through holes extending through the contact pieces 1310 and have a large holding force for holding the protruding portions 152. Therefore, compared with the outer grooves 961 formed in the outer peripheries of the contact plates 959 (see FIGS. 11 and 12), the holes 131B make the spring member 15 more difficult to be removed from the socket contact body 13. Therefore, there is no need to provide the contact portion 131 with e.g. a protruding stopper (not shown) protruding outward from the outer periphery thereof so as to limit the movement of the spring member 15 in the direction parallel to the receiving direction DI.

Further, since the metal material having high heat resistance is used as the material of the spring member 15, the spring member 15 is resistant to creep deformation, and the contact stability between the pin contact and the socket contact 10 is maintained.

Furthermore, since the part of the socket contact body 13 other than the contact portion 131 is solid, it is possible to secure a cross-sectional area of a current passage, equivalent to that of a large-current socket contact (not shown) which is formed by press work of a plate material, with a smaller size than that of the large-current socket contact.

Further, when the part of the socket contact body 13 other than the holes 131B is formed by cold forging, a continuous state of the metal fibrous structure of the metal material is maintained. Therefore, the strength of the socket contact body 13 is higher than the strength of the electric contact portion 913 of the charging connector terminal 955, shown in FIGS. 11 and 12, which is formed through cutting work which cuts the metal fibrous structure.

Furthermore, the front ends of the protruding portions 152 of the spring member 15 do not protrude into the inner space of the contact portion 131 of the socket contact body 13, and hence when the pin contact is inserted into the contact portion 131, the protruding portions 152 provide no obstacle to the pin contact, so that there is little fear that the protruding portions 152 are pushed out of the holes 131B by the pin contact, causing removal of the spring member 15 from the socket contact body 13.

Figure 8:
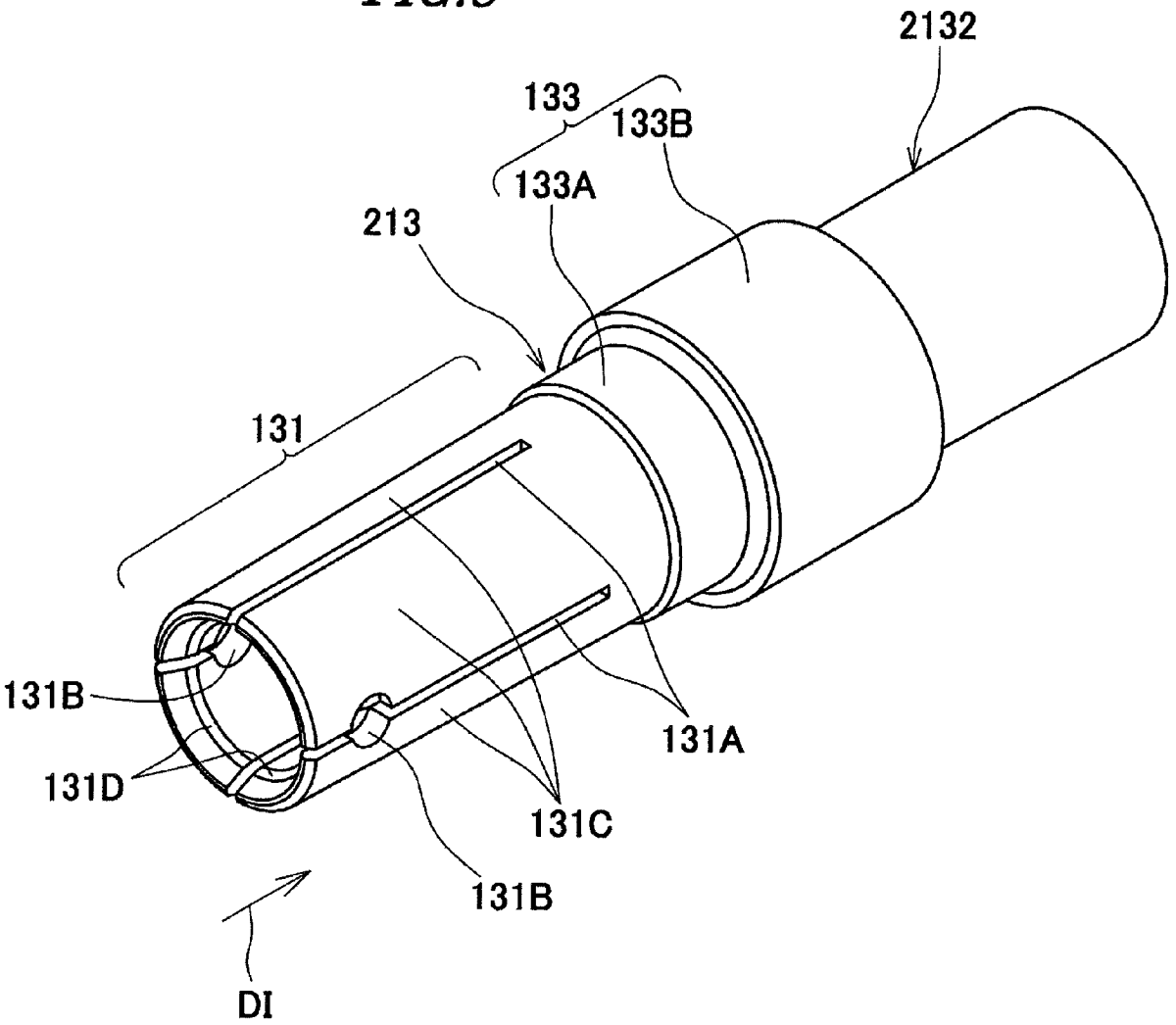
FIG. 8 is a perspective view of a socket contact body of a socket contact according to a second embodiment of the present invention.
Figure 9:
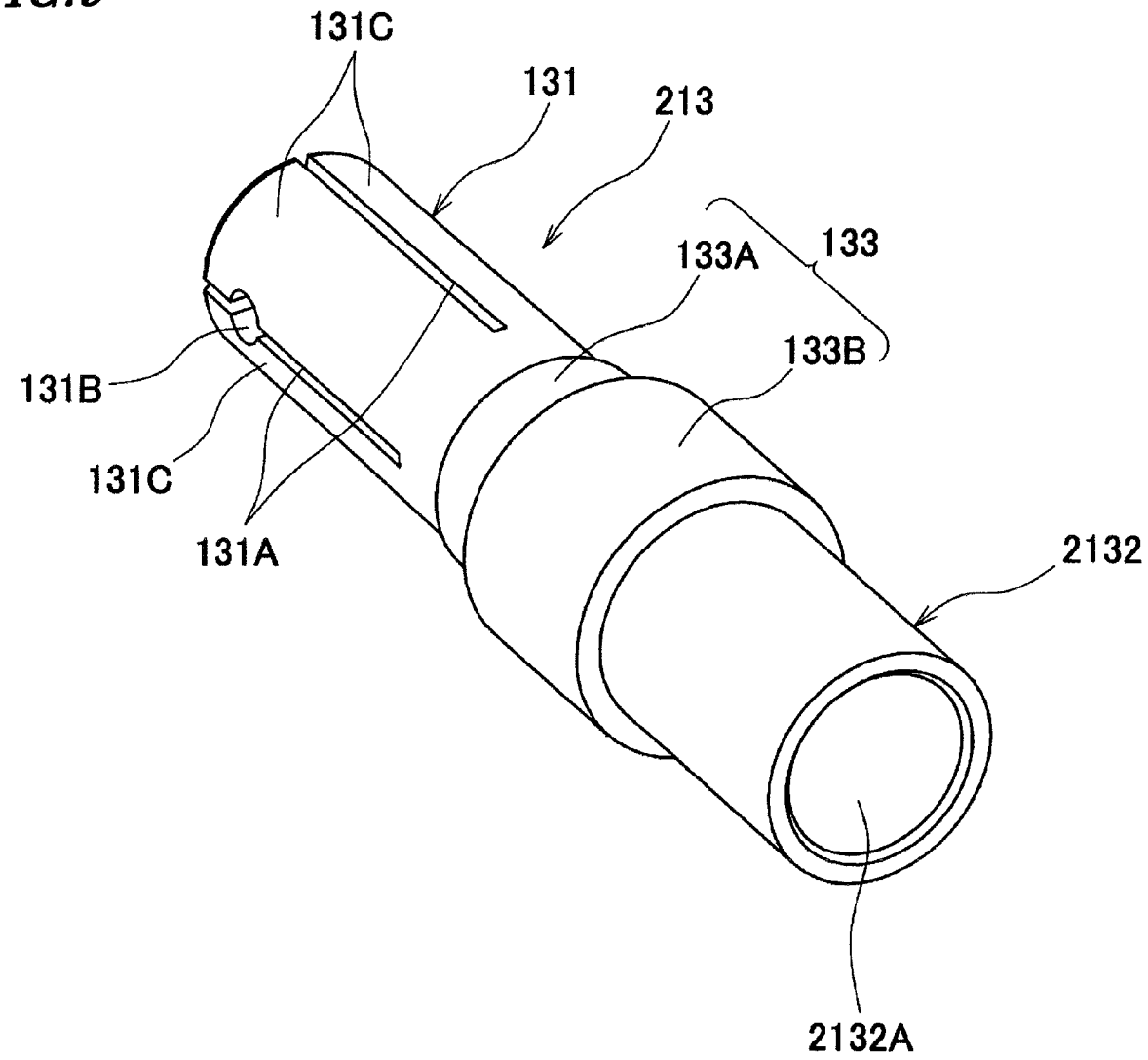
FIG. 9 is a perspective view of the socket contact body shown in FIG. 8, taken obliquely from the rear.
Figure 10:
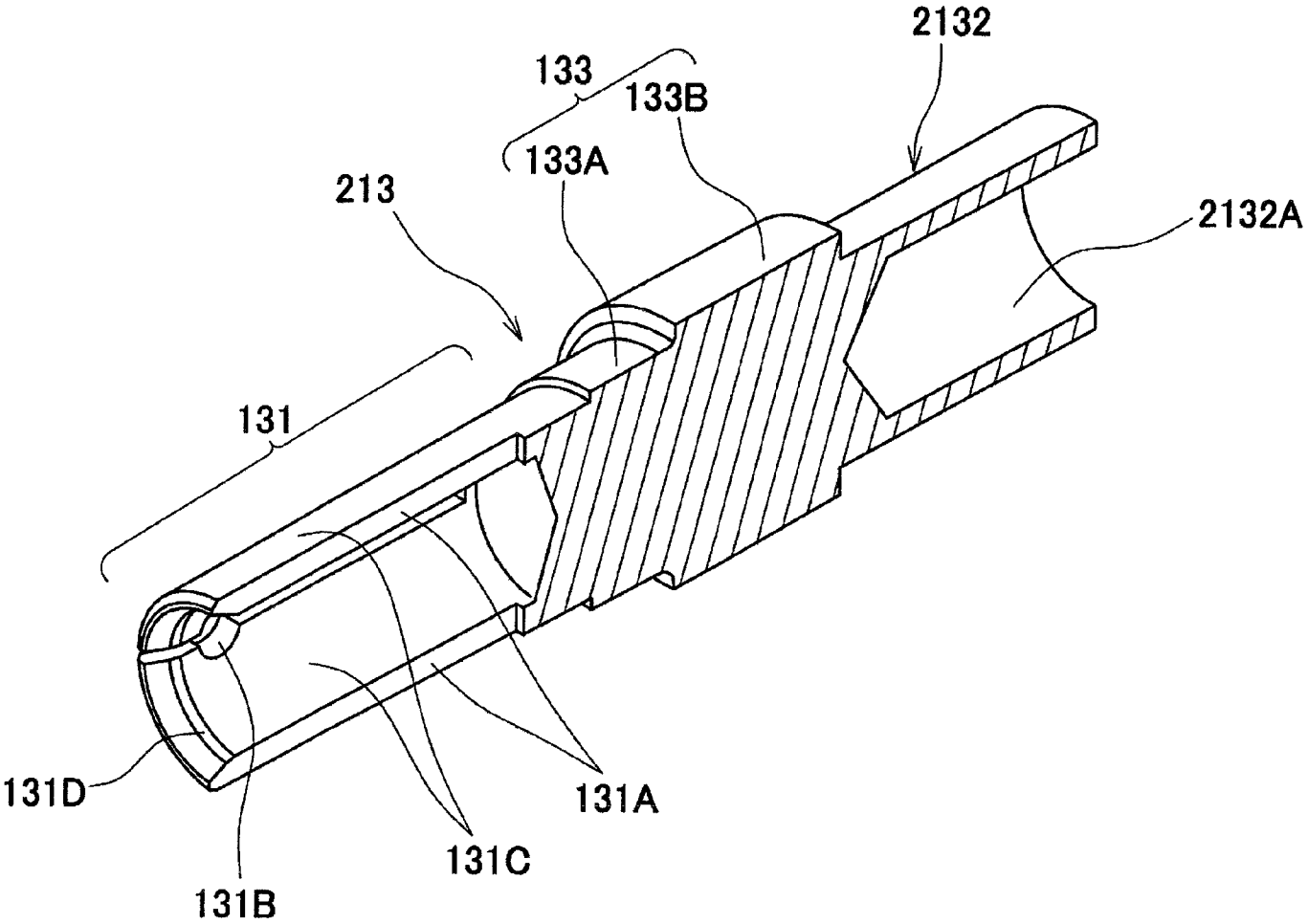
FIG. 10 is a perspective view, partly in cross-section, of the socket contact body shown in FIG. 8.

Next, a socket contact body 213 of a socket contact according to a second embodiment of the present invention will be described with reference to FIGS. 8 to 10.

The same components as those in the above-described first embodiment are denoted by the same reference numerals, and description thereof is omitted. Hereafter, only main differences from the first embodiment will be described.

The shape of a connection portion 2132 of the socket contact body 213 according to the present embodiment is different from the shape of the connection portion 132 of the socket contact body 13 according to the first embodiment. An object to be connected to the socket contact according to the second embodiment is a wire (not shown), and the connection portion 2132 is formed into a hollow cylindrical shape such that it can receive one end of the wire therein. The connection portion 2132 includes a wire connection portion 2132A extending along a central axis thereof. The connection portion 2132 can be formed by cold forging. The spring member 15 of the socket contact 10 according to the first embodiment is used as a spring member of the socket contact according to the present embodiment.

The second embodiment provides the same advantageous effects as provided by the first embodiment.

Note that although in the above-described embodiments, the spring member 15 has two protruding portions 152, the spring member 15 is only required to have at least one protruding portion 152. Further, although the number of the slits 131A is four, it is only required that at least one slit 131A is formed.

Further, although in the above-described embodiments, the slits 131A are formed by cold forging, the slits 131A and the holes 131B may be formed by removal work, such as cutting, after forming the part of the socket contact body 13 other than the slits 131A and the holes 131B by cold forging.

Note that although in the above-described embodiments, the holes 131B, which are circular, are employed as receiving portions for receiving the protruding portions 152 of the elastic annular portion 151, the holes are not limited to the circular holes 131B, but they may be rectangular holes. Further, the receiving portions are not limited to holes, but they may be cutouts.

Further, although in the above-described embodiments, to secure a larger cross-sectional area of the current passage, the holes 131E are formed such that they meet the slits 131A, respectively, the holes 131B may be formed such that they do not meet the slits 131A.

Note that although in the above-described embodiments, the protruding portions 152 of the spring member 15 are protruding pieces, it is not necessarily required to form the protruding portions 152 as protruding pieces, but they may be formed as protruding portions that protrude from the inner periphery of the elastic annular portion 151 toward the central axis of the elastic annular portion 151. Further, the protruding portions may be raised portions provided by forming U-shaped slits in the elastic annular portion 151 and bending portions surrounded by the slits such that the surrounded portions are made closer to the central axis of the elastic annular portion 151.

Further, although in the above-described embodiments, the protruding portions 152 are manually bent using the jig, they may be bent using a machine.

Note that although in the above-described embodiments, the contact portion 131 has elasticity and the contact pieces 131C are elastically deformable, the contact portion 131 is not necessarily required to have elasticity.

Note that although in the above-described embodiment, the description has been given of the case where the present invention is applied to a large-current socket contact, the present invention may be applied to a socket contact other than the large-current socket contact.

It is further understood by those skilled in the art that the foregoing are the preferred embodiments of the present invention, and that various changes and modification may be made thereto without departing from the spirit and scope thereof.

What is claimed is:

1. A socket contact comprising:

a socket contact body including a contact portion, which has a hollow cylindrical shape, for receiving a pin contact therein; and a spring member fitted on the socket contact body, the spring member including an elastic annular portion fitted on an outer periphery of the contact portion, and a plurality of protruding portions provided on the elastic annular portion, wherein the contact portion has a plurality of slits formed therein which extend in a direction of receiving the pin contact, wherein the contact portion further has a plurality of receiving portions formed therein for receiving the respective plurality of protruding portions and for limiting movement of the elastic annular portion in a direction parallel to the direction of receiving the pin contact, wherein the contact portion further has a contact point portion that is adapted to be pressed against an outer periphery of the pin contact by a returning force of the elastic annular portion when the pin contact is received into the contact portion, and wherein the plurality of receiving portions are formed so as to respectively meet the plurality of slits.

2. The socket contact according to claim 1, wherein when the plurality of receiving portions have received the respective plurality of protruding portions therein, front ends of the plurality of protruding portions do not protrude inward of an inner peripheral surface of the contact portion.

3. The socket contact according to claim 1, wherein each of the plurality of receiving portions is a hole or a cutout.

4. The socket contact according to claim 2, wherein each of the plurality of receiving portions is a hole or a cutout.

5. The socket contact according to claim 1, wherein the socket contact body further includes a body portion having a cylindrical shape, and a connection portion provided at one end of the body portion, for being connected to an object to be connected, and wherein the contact portion has elasticity, and is provided at the other end of the body portion.

6. The socket contact according to claim 2, wherein the socket contact body further includes a body portion having a cylindrical shape, and a connection portion provided at one end of the body portion, for being connected to an object to be connected, and wherein the contact portion has elasticity, and is provided at the other end of the body portion.

7. The socket contact according to claim 3, wherein the socket contact body further includes a body portion having a cylindrical shape, and a connection portion provided at one end of the body portion, for being connected to an object to be connected, and wherein the contact portion has elasticity, and is provided at the other end of the body portion.

8. The socket contact according to claim 5, wherein the object to be connected is a wire, and wherein the connection portion is formed to have a hollow cylindrical shape such that the connection portion can receive one end of the wire therein.

9. The socket contact according to claim 6, wherein the object to be connected is a wire, and wherein the connection portion is formed to have a hollow cylindrical shape such that the connection portion can receive one end of the wire therein.

10. The socket contact according to claim 7, wherein the object to be connected is a wire, and wherein the connection portion is formed to have a hollow cylindrical shape such that the connection portion can receive one end of the wire therein.

11. The socket contact according to claim 1, wherein the plurality of slits comprise four slits, and the four slits are arranged at equally-spaced intervals in a circumferential direction of the contact portion.

12. The socket contact according to claim 1, wherein the socket contact body is made of a pure copper-based material.

13. The socket contact according to claim 1, wherein the spring member is made of a metal material having high heat resistance.

14. The socket contact according to claim 1, wherein the socket contact body except the receiving portion is made by cold forging.

* * * * *